US007667404B2

(12) United States Patent
Ahn

(10) Patent No.: US 7,667,404 B2
(45) Date of Patent: Feb. 23, 2010

(54) PLASMA DISPLAY APPARATUS

(75) Inventor: Young Joon Ahn, Gumi-si (KR)

(73) Assignee: LG Electronics Inc., Seoul (KR)

( * ) Notice: Subject to any disclaimer, the term of this patent is extended or adjusted under 35 U.S.C. 154(b) by 396 days.

(21) Appl. No.: 11/346,584

(22) Filed: Feb. 3, 2006

(65) Prior Publication Data

US 2006/0279212 A1 Dec. 14, 2006

(30) Foreign Application Priority Data

Jun. 10, 2005 (KR) ..... 10-2005-0049975
Aug. 30, 2005 (KR) ..... 10-2005-0080264

(51) Int. Cl.
*H01J 17/49* (2006.01)

(52) U.S. Cl. ..... 313/583; 313/585

(58) Field of Classification Search ..... 312/485, 312/582–586; 313/485, 582–586
See application file for complete search history.

(56) References Cited

U.S. PATENT DOCUMENTS 5,742,122 A * 4/1998 Amemiya et al. ..... 313/582
2003/0132709 A1* 7/2003 Harada et al. ..... 313/582
2005/0093449 A1* 5/2005 Su et al. ..... 313/584

* cited by examiner

*Primary Examiner*—Nimeshkumar D. Patel
*Assistant Examiner*—Mary Ellen Bowman
(74) *Attorney, Agent, or Firm*—Ked & Associates LLP

(57) ABSTRACT

A plasma display apparatus is provided. Polygonal discharge cells are arranged in delta. Extension parts are extended from pairs of sustain electrodes that apply a voltage to the discharge cells to discharge spaces to face each other. Since the extension parts have at least one depressed parts, the efficiency of sustain discharge improves due to a long gap. Since the width of data electrodes formed under the discharge cells is large in the discharge spaces, a distance between the effective side surfaces of the pairs of sustain electrodes and the data electrodes is reduced so that the efficiency of address discharge improves.

30 Claims, 7 Drawing Sheets

PLASMA DISPLAY APPARATUS

BACKGROUND OF THE INVENTION

1. Field of the Invention

The present invention relates to a plasma display apparatus, and more particularly, to the structures of electrodes capable of improving efficiencies of sustain discharge and address discharge in discharge cells arranged in delta.

2. Description of the Background Art

In a plasma display apparatus, discharge cells are formed between a rear surface substrate on which barrier ribs are formed and a front surface substrate that faces the rear surface substrate and vacuum ultraviolet (UV) rays generated when inert gases in the discharge cells are discharged by a high frequency voltage emit light from a phosphor to realize an image.

FIG. 1 is a sectional view illustrating a discharge cell of a common plasma display panel (PDP).

First, the discharge cell is formed by a plurality of barrier ribs 24 with which a discharge space is partitioned off on a rear surface substrate 18 that faces a front surface substrate 10. FIG. 1 illustrates that square delta barrier ribs partition off the discharge cell.

A data electrode X is arranged on the rear surface substrate 18 and a scan electrode Y and a sustain electrode Z are arranged on the front surface substrate 10 to make a pair. The rear surface substrate 18 illustrated in FIG. 1 is rotated at 90° so that the data electrode X intersects the other electrodes Y and Z.

A lower dielectric layer 22 for accumulating wall charges is formed on the rear surface substrate 18 where the data electrode X is formed.

The barrier ribs 24 are arranged on the dielectric layer 22 to form a discharge space between the barrier ribs and to prevent the UV rays and visible rays generated by discharge from leaking to adjacent discharge cells. The surfaces of the dielectric layer 22 and the barrier ribs 24 are coated with a phosphor 26.

Since inert gases are implanted into the discharge space, the phosphor 26 is excited by the UV rays generated when the gases are discharged to generate one visible ray among red, green, and blue visible rays.

The scan electrode Y and the sustain electrode Z arranged on the front surface substrate 10 are composed of transparent electrodes 12Y and 12Z and bus electrodes 13Y and 13Z to intersect the data electrode X. Also, a dielectric layer 14 and a protective layer 16 that cover the scan electrode Y and the sustain electrode Z are formed.

After the discharge cell of such a structure is selected by facing discharge between the data electrode X and the scan electrode Y, discharge is sustained by surface discharge between the scan electrode Y and the sustain electrode Z so that the visible rays are emitted.

The scan electrode Y and the sustain electrode Z are composed of the transparent electrodes 12Y and 12Z and the bus electrodes 13Y and 13Z whose width is smaller than the width of the transparent electrodes 12Y and 12Z and each of which is formed at one edge of each of the transparent electrodes 12Y and 12Z.

FIG. 2 is a plan view illustrating conventional square delta barrier ribs before performing an annealing process. FIG. 3 is a plan view illustrating hexagonal delta barrier ribs after performing the annealing process.

The square delta barrier ribs 24 are composed of first barrier ribs 24*a* that are horizontally formed and second barrier ribs 24*b* formed in the same direction as the data electrode X. Since the directions in which the square delta barrier ribs 24 are contracted by thermal stress vary at the intersections between the first and second barrier ribs 24*a* and 24*b* during the annealing process performed at 550 to 600° C. as illustrated in FIG. 2, the square delta barrier ribs 24 are transformed into hexagonal delta barrier ribs as illustrated in FIG. 3.

The hexagonal delta barrier ribs illustrated in FIG. 3 have advantage in that the area coated with the phosphor increases. However, since the bus electrodes 13Y and 13Z that overlap the first barrier ribs 24*a* intercept the discharge space to which the visible rays are emitted, emission efficiency and brightness deteriorate.

SUMMARY OF THE INVENTION

Accordingly, an object of the present invention is to solve at least the problems and disadvantages of the background art.

It is an object of the present invention to provide a plasma display apparatus including three or more cells arranged on a rear surface substrate to be partitioned off by barrier ribs in delta, data electrodes arranged under the cells, pairs of sustain electrodes arranged on a front surface substrate attached to the rear surface substrate to at least partially intersect the barrier ribs, and at least one extension parts extended from the pairs of sustain electrodes to the insides of the cells to face each other and having at least one depressed parts.

The barrier ribs includes first barrier ribs that at least partially overlap the pairs of sustain electrodes and second barrier ribs that at least partially overlap the data electrodes and the first barrier ribs.

The at least one depressed parts face each other in the cells. A distance between the extension parts is 60 to 180 μm.

Also, the data electrodes at least partially overlap the at least one extension parts and/or depressed parts in the cells.

There is also provided a plasma display apparatus including three or more cells arranged on a rear surface substrate to be partitioned off by barrier ribs in delta, data electrodes arranged under the cells and having wide parts and narrow parts, pairs of sustain electrodes arranged on a front surface substrate attached to the rear surface substrate to at least partially intersect the barrier ribs, and at least one extension parts extended from the pairs of sustain electrodes to the insides of the cells to face each other.

The barrier ribs include first barrier ribs that at least partially overlap the pairs of sustain electrodes and second barrier ribs that at least partially overlap the data electrodes and the first barrier ribs.

Also, the wide parts are formed in the cells that are discharge spaces and the narrow parts at least partially overlap second barrier ribs that partition off the cells and that are non-discharge spaces.

Also, the data electrodes at least partially overlap the at least one extension parts and/or depressed parts in the cells.

There is also provided a plasma display apparatus including three or more cells arranged on a rear surface substrate to be partitioned off by barrier ribs in delta, data electrodes arranged under the cells and having wide parts and narrow parts, pairs of sustain electrodes arranged on a front surface substrate attached to the rear surface substrate to at least partially intersect the barrier ribs, and at least one extension parts extended from the pairs of sustain electrodes to the insides of the cells to face each other and having at least one depressed parts.

The barrier ribs include first barrier ribs that at least partially overlap the pairs of sustain electrodes and second barrier ribs that at least partially overlap the data electrodes and the first barrier ribs.

A distance between the extension parts is 60 to 180 μm. Extension parts in the adjacent cells are intercepted from each other. The at least one depressed parts formed in the extension parts face each other.

The wide parts are formed in the cells that are discharge spaces and the narrow parts at least partially overlap second barrier ribs that partition off the cells and that are non-discharge spaces.

The at least one extension parts at least partially overlap the wide parts in the cells. The at least one depressed parts at least partially overlap the wide parts.

The width of the wide parts is 75% to 150% of the width of the extension parts. The width of the narrow parts is 5% to 75% of the width of the extension parts. At least one hole is formed in the narrow part.

BRIEF DESCRIPTION OF THE DRAWINGS

The present invention will be described in detail with reference to the following drawings in which like numerals refer to like elements.

DETAILED DESCRIPTION OF PREFERRED EMBODIMENTS

Delta discharge cells of a plasma display panel (PDP) according to preferred embodiments of the present invention and the structures of the electrodes of the discharge cells will be described in a more detailed manner with reference to the drawings.

Preferred embodiments of the delta discharge cells of the PDP according to the present invention and the structures of the electrodes of the discharge cells may be plural and are not limited to the embodiments described in the specification.

Figure 1:
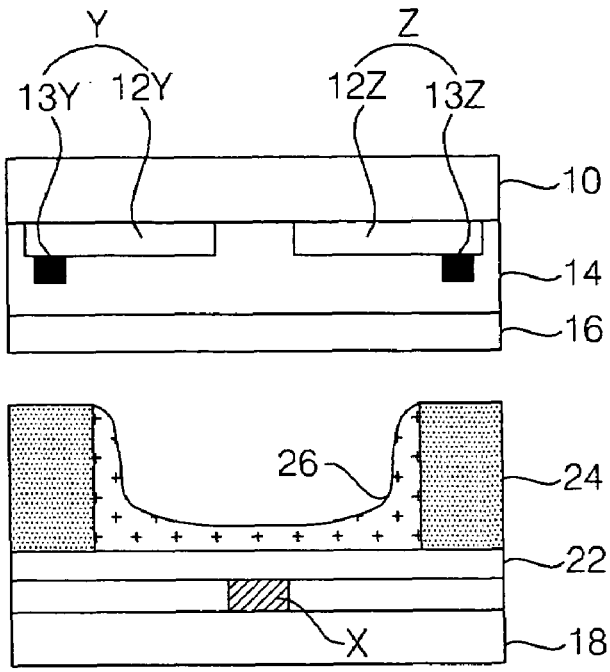
FIG. 1 (Prior Art)
FIG. 1 is a sectional view of a discharge cell partitioned off by conventional square delta barrier ribs.
Figure 2:
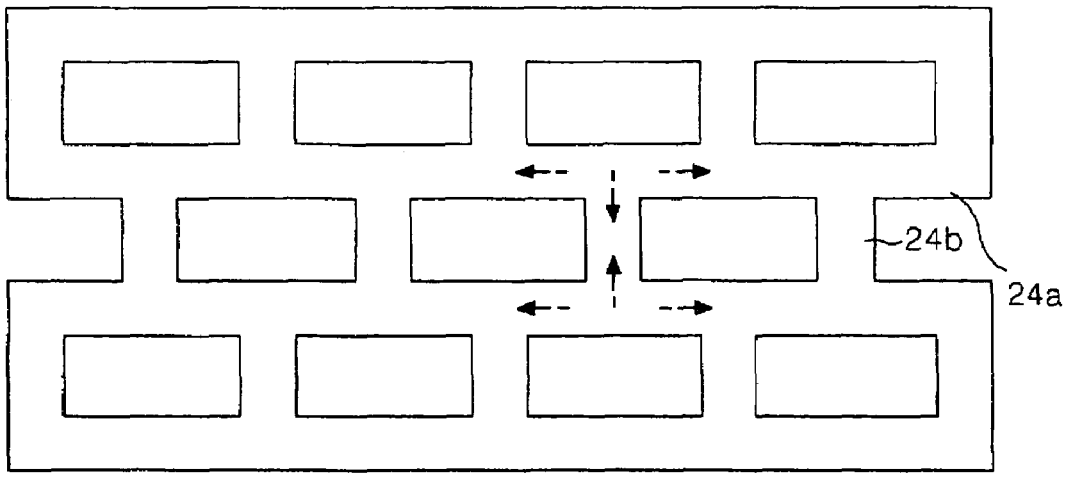
FIG. 2 (Prior Art)
FIG. 2 is a plan view illustrating the square delta barrier ribs illustrated in FIG. 1 before an annealing process.
Figure 3:
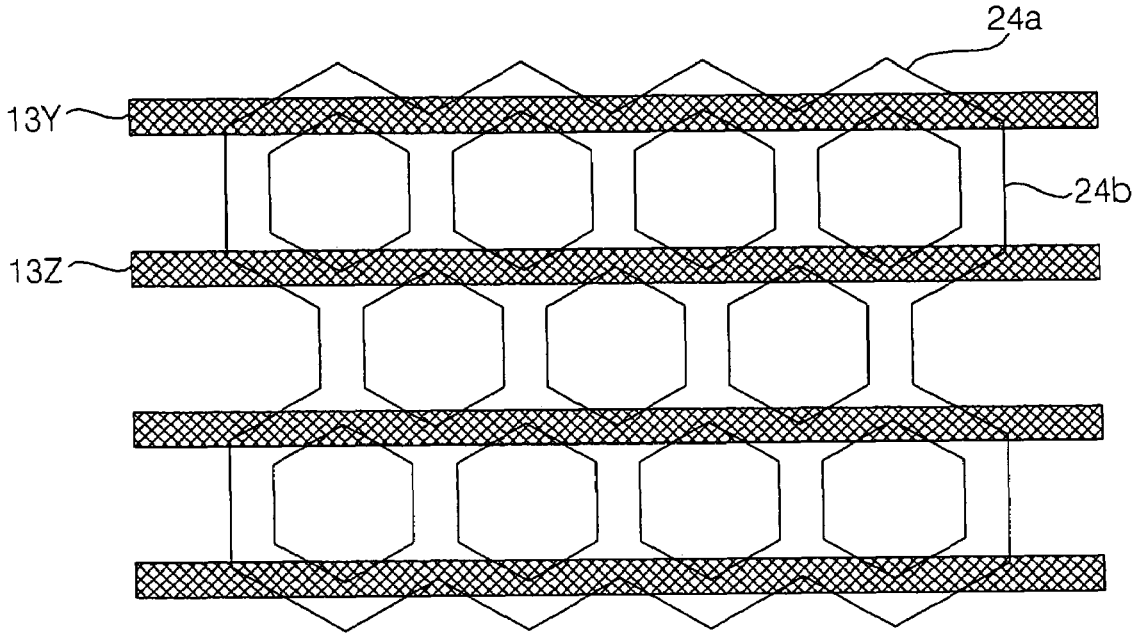
FIG. 3 (Prior Art)
FIG. 3 is a plan view illustrating hexagonal delta barrier ribs after the annealing process.
Figure 4:
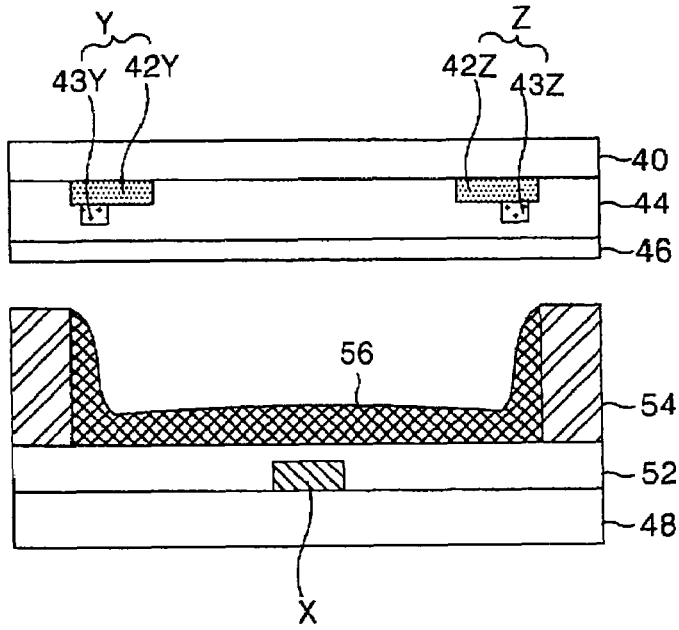
FIG. 4 is a sectional view of a discharge cell partitioned off by hexagonal delta barrier ribs according to the present invention.
Figure 5:
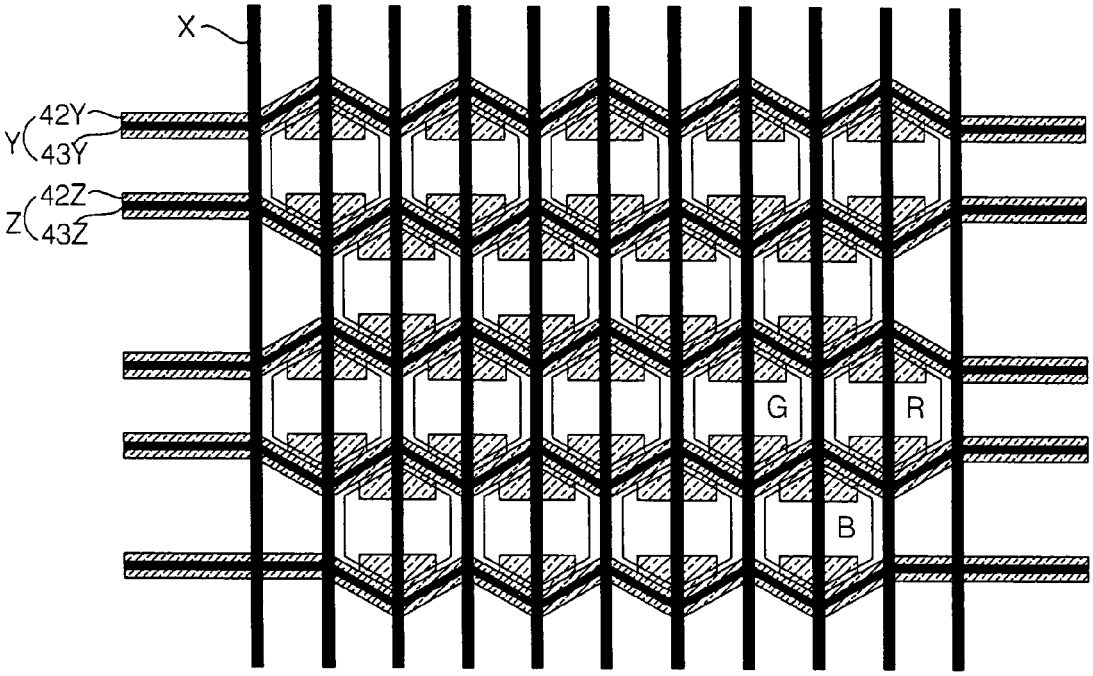
FIG. 5 illustrates the arrangements of discharge cells and electrodes according to a first embodiment.
Figure 6:
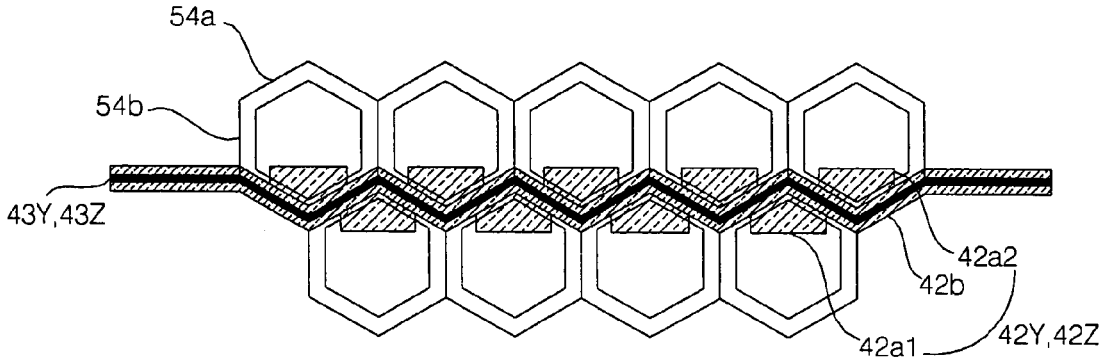
FIG. 6 illustrates the structures of the discharge cells and the electrodes according to the first embodiment.

FIG. 4 is a sectional view illustrating the structure of a delta discharge cell according to the present invention. FIGS. 5 and 6 illustrate the structures of the electrodes of the delta discharge cells.

The plasma display apparatuses according to the first to fourth embodiments have a delta structure in which the discharge cells adjacent to each other in the up and down direction form a pixel.

That is, the PDP according to the present invention forms the R, G, and B discharge cells arranged in delta. According to the present specification, the discharge cells are hexagonal. However, the discharge cells may be square discharge cells, pentagonal discharge cells, other polyhedral discharge cells, curved discharge cells, or amorphous discharge cells.

The plasma display apparatus according to the present invention includes data electrodes X and pairs of sustain electrodes Y and Z that intersect the data electrodes X. At this time, first barrier ribs 54*a* at least partially overlap the pairs of sustain electrodes Y and Z and second barrier ribs 54*b* at least partially overlap the data electrodes X and the first barrier ribs 54*a*.

The scan electrode Y and the sustain electrode Z of the pair of sustain electrodes are composed of transparent electrodes 42Y and 42Z and bus electrodes 43Y and 43Z whose width is smaller than the width of the transparent electrodes 42Y and 42Z. The bus electrodes 43Y and 43Z are formed along the first barrier ribs 54*a* that overlap the pairs of sustain electrodes Y and Z at one edge of each of the transparent electrodes 42Y and 42Z.

The transparent electrodes 42Y and 42Z are commonly formed of indium tin oxide (ITO) on a front surface substrate. That is, the transparent electrodes 42Y and 42Z are connected to the bus electrodes 43Y and 43Z as illustrated in FIGS. 5 and 6 and include connection parts 42*b* formed along the first barrier ribs 54*a* that partition off the hexagonal discharge cells in delta and extension parts 42*a*1 and 42*a*2 that are extended up and down from the connection parts 42*b* to the insides of the discharge cells with predetermined width.

Therefore, the data electrodes X are formed to cross the centers of the hexagonal discharge cells as illustrated in FIG. 5 and the extension parts 42*a*1 and 42*a*2 of the transparent electrodes 42Y and 42Z overlap the data electrodes X. Also, the extension parts 42*a*1 and 42*a*2 that are extended from the transparent electrodes 42Y and 42Z face each other.

The bus electrodes 43Y and 43Z reduce drop in voltage caused by the transparent electrodes 42Y and 42Z having high resistance and supply voltage signals to the transparent electrodes 42Y and 42Z. Therefore, the bus electrodes 43Y and 43Z are connected to the connection parts 42*b* of the transparent electrodes 42Y and 42Z in order to supply driving signals to the transparent electrodes 42Y and 42Z of the discharge cells.

Also, the bus electrodes 43Y and 43Z are formed of at least one of Ag, Cu, and Cr to be connected to the transparent electrodes 42Y and 42Z and to partially overlap the first barrier ribs 54*a*.

An upper dielectric layer 44 and a protective layer 46 are formed on the front surface substrate 40 where the pairs of sustain electrodes Y and Z are formed. Wall charges generated during plasma discharge are accumulated on the upper dielectric layer 44. The protective layer 46 prevents the upper dielectric layer 44 from being damaged by sputtering generated during plasma discharge and improves the emission efficiency of secondary electrons.

A lower dielectric layer 52 on which wall charges are accumulated is formed on a rear surface substrate 48 where the data electrodes X are formed. Barrier ribs 54 that prevent ultraviolet (UV) rays and visible rays generated by discharge from leaking to adjacent discharge cells are arranged on the lower dielectric layer 52. The surfaces of the lower dielectric layer 52 and the barrier ribs 54 are coated with a phosphor 56.

The phosphor 56 is excited by the UV rays generated during plasma discharge to generate one visible ray among red, green, and blue visible rays. Inert gases for gas discharge are implanted into discharge spaces provided between the front and rear surface substrates 40 and 48 and the barrier ribs 54.

As described above, since the first barrier ribs 54*a* overlap the bus electrodes 43Y and 43Z in the plasma display apparatus according to the first embodiment, the discharge spaces to which the visible rays are emitted are not intercepted by the bus electrodes 43Y and 43Z. Also, since the connection parts 42*b* of the transparent electrodes 42Y and 42Z are connected to the bus electrodes 43Y and 43Z and the extension parts 42*a*1 and 42*a*2 of the transparent electrodes 42Y and 42Z protrude to the insides of the discharge cells in the plasma display apparatus according to the first embodiment, discharge efficiency is improved.

Figure 7:
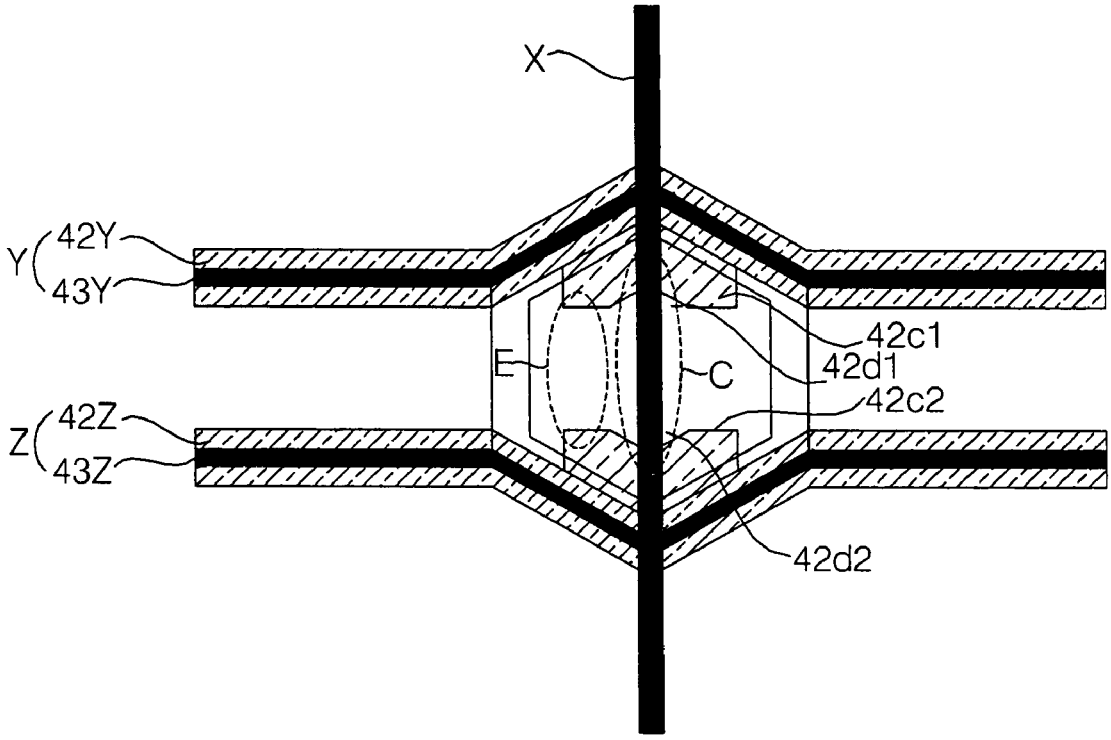
FIG. 7 illustrates the structures of a discharge cell and electrodes according to a second embodiment.

FIG. 7 illustrates the structures of a discharge cell and electrodes of a plasma display apparatus having a delta barrier rib structure according to a second embodiment. The second embodiment illustrated in FIG. 7 is similar to the first embodiment illustrated in FIGS. 4 to 6, however, is different from the first embodiment illustrated in FIGS. 4 to 6 in that depressed parts are formed in the extension parts of the transparent electrodes.

As illustrated in FIG. 7, a first extension part 42*c*1 that intersects the data electrode X and that is extended from the scan electrode Y and a second extension part 42*c*2 that intersects the data electrode X and that is extended from the sustain electrode Z are provided in the discharge cell. Here, the first extension part 42*c*1 and the second extension part 42*c*2 face each other.

First and second depressed parts 42*d*1 and 42*d*2 are formed on the facing surfaces of the first and second extension parts 42*c*1 and 42*c*2 so that a distance between the center C of the first extension part 42*c*1 and the center C of the second extension part 42*c*2 is different from a distance between the edge E of the first extension part 42*c*1 and the edge E of the second extension part 42*c*2.

Figure 10:
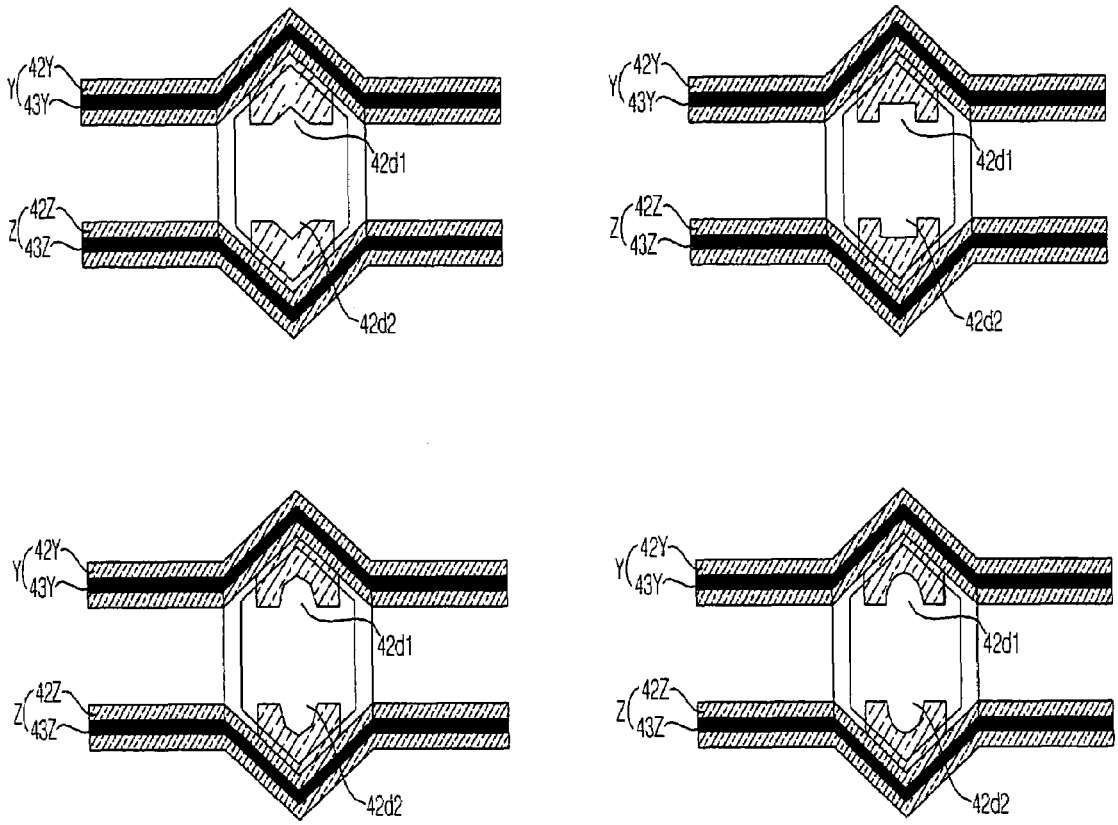
FIG. 10 illustrates the shapes of the electrodes applied to the second and fourth embodiments.

That is, since the first and second depressed parts 42*d*1 and 42*d*2 are formed in the centers C of the first and second extension parts 42*c*1 and 42*c*2 as illustrated in FIG. 7, when a power source is supplied to the scan electrode Y and the sustain electrode Z, a weak electric field is formed in the centers C and a strong electric field is formed at the edges E. Here, the distance between the centers C of the first and second extension parts 42*c*1 and 42*c*2 is large to form a long gap and the depressed parts 42*d*1 and 42*d*2 may be polygonal and circular as illustrated in FIG. 10.

The length of the long gap between the transparent electrodes formed by the first and second depressed parts 42*d*1 and 42*d*2 is within 60 to 180 μm based on a resolution VGA level.

As described above, in the plasma display apparatus according to the second embodiment, since the distance between the centers C of the extension parts 42*c*1 and 42*c*2 of the transparent electrodes to which a voltage that generates discharge is applied is larger than the distance between the edges E of the extension parts 42*c*1 and 42*c*2 of the transparent electrodes to which a voltage that generates discharge is applied due to the depressed parts 42*d*1 and 42*d*2, it is possible to secure a larger positive column region in which discharge starts than in the first embodiment where the distance between the centers C of the extension parts 42*c*1 and 42*c*2 is equal to the distance between the edges E of the extension parts 42*c*1 and 42*c*2. Therefore, it is possible to improve contrast.

Figure 8:
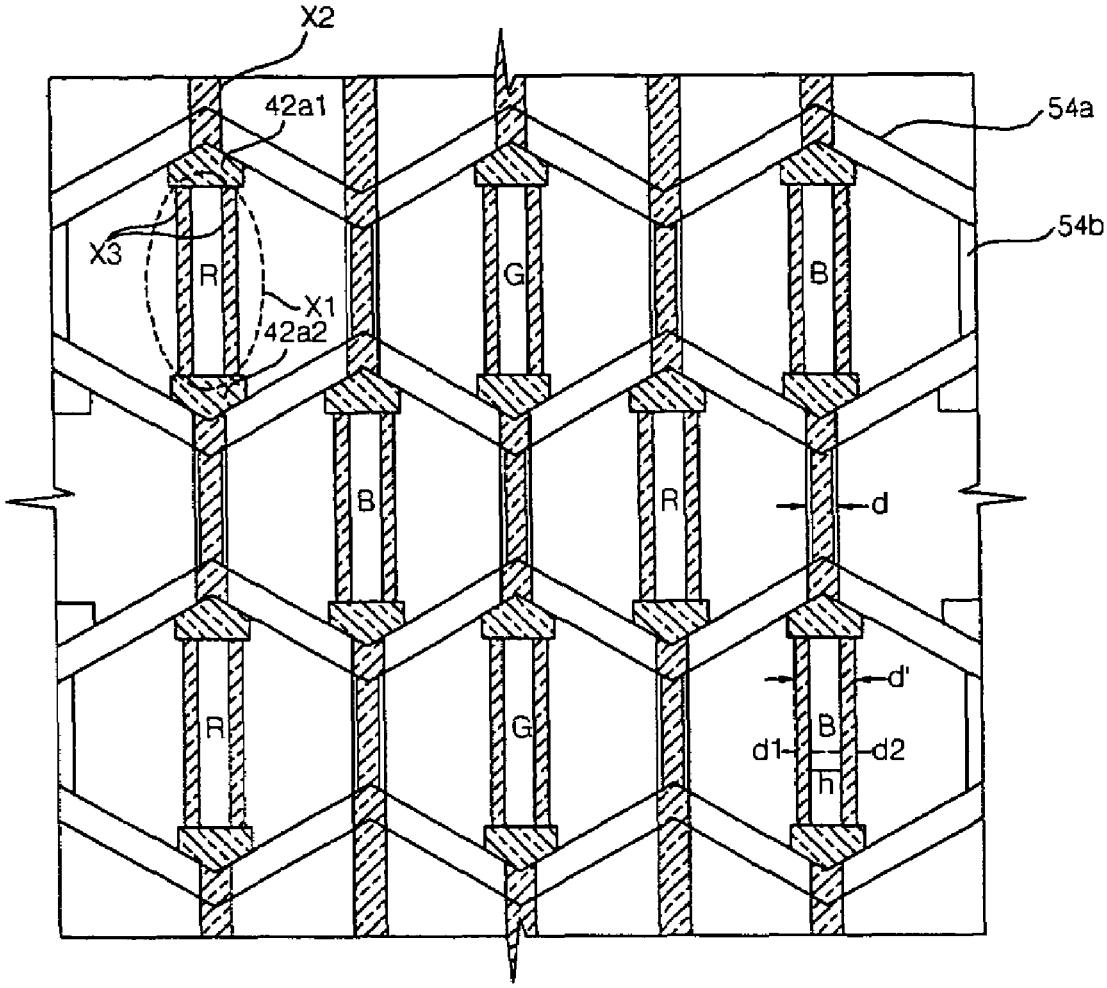
FIG. 8 illustrates the structures of discharge cells and electrodes according to a third embodiment.

FIG. 8 illustrates the structures of discharge cells and electrodes of a plasma display apparatus having a delta barrier rib structure according to a third embodiment. The third embodiment illustrated in FIG. 8 is similar to the first embodiment illustrated in FIGS. 4 to 6, however, is different from the first embodiment illustrated in FIGS. 4 to 6 in that the shape of the data electrodes that overlap the barrier ribs is different from the shape of the data electrodes that overlap the discharge spaces and that holes are formed in the data electrodes that overlap the discharge spaces.

As illustrated in FIG. 8, hexagonal discharge cells are partitioned off by the first barrier ribs 54*a* and the second barrier ribs 54*b* and the discharge cells partitioned by the barrier ribs 54*a* and 54*b* are arranged in delta.

The pair of sustain electrodes arranged on the front surface substrate are composed of the scan electrode Y and the sustain electrode Z. The scan electrode Y and the sustain electrode Z are composed of the transparent electrodes 42Y and 42Z and the bus electrodes 43Y and 43Z whose width is smaller than the width of the transparent electrodes 42Y and 42Z.

Also, the transparent electrodes 42Y and 42Z include the connection parts 42*b* formed along the first barrier ribs 54*a* that partition off the hexagonal discharge cells in delta and the extension parts 42*a*1 and 42*a*2 that are extended from the connection parts 42*b* to the insides of the discharge cells with predetermined width and that face each other to make pairs as described in the first embodiment.

Also, the data electrodes arranged on the rear surface substrate may be divided into wide parts X1 and narrow parts X2. At this time, the maximum width d' of the wide parts X1 of the data electrodes is about 75% to 150% of the maximum width of the extension parts 42*a*1 and 42*a*2 of the transparent electrodes and the maximum width d of the narrow parts X2 of the data electrodes is about 5% to 75% of the maximum width of the extension parts 42*a*1 and 42*a*2 of the transparent electrodes.

As described above, the wide parts X1 are provided in the data electrodes in order to improve the efficiency of facing discharge (address discharge) generated between the scan electrodes and the data electrodes. Recently, a gap between the scan electrodes and the sustain electrodes is large in order to improve discharge efficiency. When the data electrodes have the wide parts X1, although a long gap is formed between the scan electrodes and the sustain electrodes, a discharge voltage for facing discharge does not significantly increase so that it is possible to improve driving efficiency.

The wide part X1 of the data electrode having the above-described structure may be formed of an electrode whose width is larger than the width of the narrow part X2 without a hole or an electrode including a hole between a plurality of narrow parts X3.

Also, the width d' of the wide parts X1 may vary in at least one discharge cell in accordance with the discharge characteristics of the R, G, and B discharge cells. For example, the width d' of the wide parts X1 may be in the order of B>G>R or B>R>G.

As illustrated in FIG. 8, when the plurality of narrow parts X3 are connected to each other to form the wide part X1, the widths d1 and d2 of the narrow parts X3 are 1% to 30% of the maximum width of the extension parts 42*a*1 and 42*a*2 of the transparent electrodes, respectively.

A hole is formed between the narrow parts X3 so that the width h of the hole is 5% to 80% of the maximum width of the extension parts 42*a*1 and 42*a*2 of the transparent electrodes and 50% to 110% of the width of the second barrier rib 54*b*.

When the width h of the hole is smaller than 50% of the width of the second barrier rib 54*b*, the size of the hole is so small that it is not possible to save the material cost of the data electrode. When the width h of the hole is larger than 110%, since the size of the hole is so large that the widths d1 and d2 of the narrow parts of the data electrode are reduced, the efficiency of facing discharge between the pair of sustain electrodes and the data electrode deteriorates.

As described above, according to the third embodiment, the width d' of the data electrode is large in the discharge space and then, the hole is formed in the data electrode in the discharge space so that a distance between the effective side surfaces of the scan electrode and the data electrode that participate in address discharge is reduced. Therefore, it is possible to reduce jitter generated during address discharge and to thus improve the discharge efficiency of the PDP.

Figure 9:
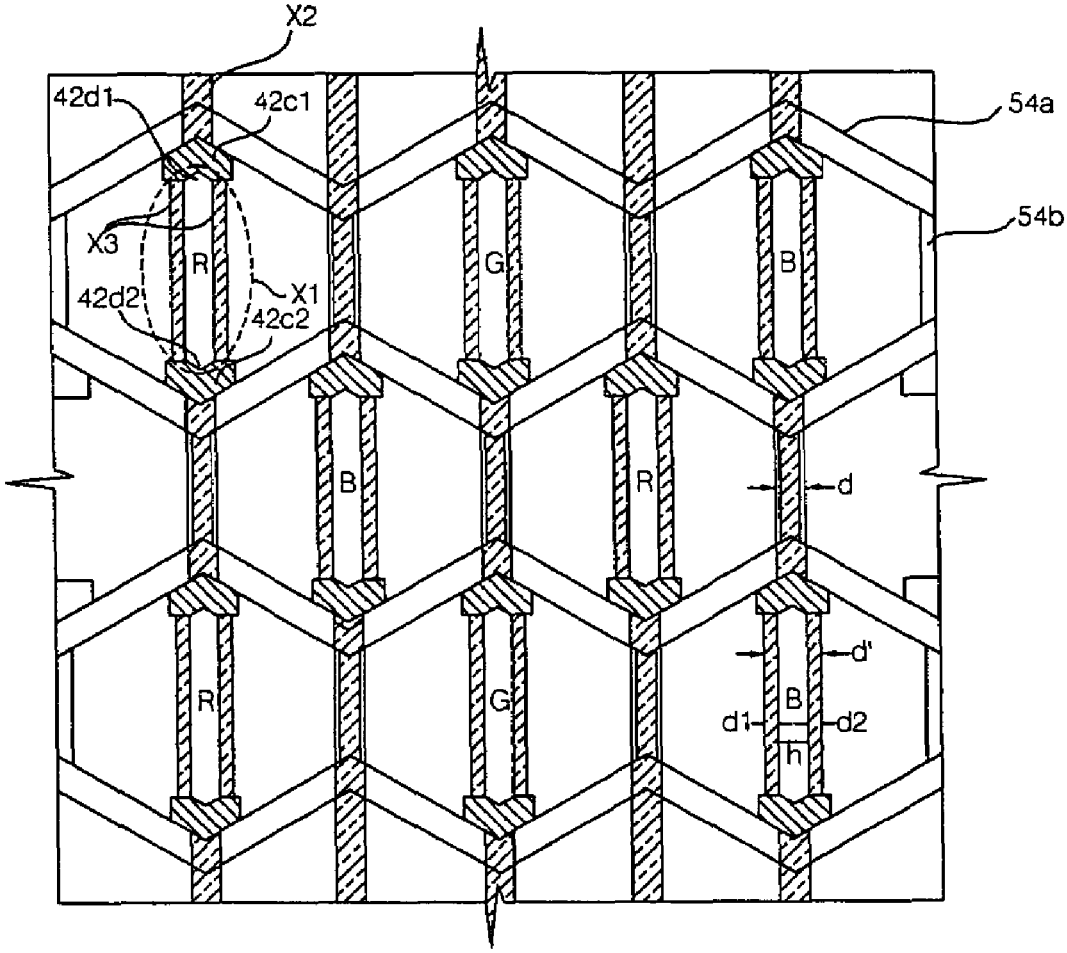
FIG. 9 illustrates the structures of discharge cells and electrodes according to a fourth embodiment.

FIG. 9 illustrates the structures of discharge cells and electrodes of a plasma display apparatus having a delta barrier rib structure according to a fourth embodiment. According to the fourth embodiment illustrated in FIG. 9, the depressed parts 42*d*1 and 42*d*2 are formed in the extension parts 42*c*1 and 42*c*2 of the transparent electrodes as illustrated in FIG. 7 and the data electrodes composed of the wide parts X1 and the narrow parts X2 are formed as illustrated in FIG. 8.

The first extension part 42*c*1 that intersects the data electrode X and that is extended from the scan electrode Y and the second extension part 42*c*2 that intersects the data electrode X and that is extended from the sustain electrode Z are provided in the discharge cell. Here, the first and second extension parts 42*c*1 and 42*c*2 face each other.

The first and second depressed parts 42*d*1 and 42*d*2 are formed on the facing surfaces of the first and second extension parts 42*c*1 and 42*c*2 so that the distance between the centers C of the first and second extension parts 42*c*1 and 42*c*2 is different from the distance between the edges E of the first and second extension parts 42*c*1 and 42*c*2. The first and second depressed parts 42*d*1 and 42*d*2 may be polygonal and circular as illustrated in FIG. 10.

The length of the long gap between the transparent electrodes formed by the first and second depressed parts 42*d*1 and 42*d*2 is within 60 to 180 μm based on a resolution VGA level.

Also, the data electrodes arranged on the rear surface substrate may be divided into wide parts X1 and narrow parts X2. At this time, the maximum width d' of the wide parts X1 of the data electrodes is about 75% to 150% of the maximum width of the extension parts 42*c*1 and 42*c*2 of the transparent electrodes and the maximum width d of the narrow parts X2 of the data electrodes is about 5% to 75% of the maximum width of the extension parts 42*c*1 and 42*c*2 of the transparent electrodes.

The wide part X1 of the data electrode may be formed of an electrode whose width is larger than the width of the narrow part X2 without a hole or an electrode including a hole between a plurality of narrow parts X3.

Also, the width d' of the wide parts X1 may vary in at least one discharge cell in accordance with the discharge characteristics of the R, G, and B discharge cells. For example, the width d' of the wide parts X1 may be in the order of B>G>R or B>R>G.

As illustrated in FIG. 9, when the plurality of narrow parts X3 are connected to each other to form the wide part X1, the widths d1 and d2 of the narrow parts X3 are 1% to 30% of the maximum width of the extension parts 42*c*1 and 42*c*2 of the transparent electrodes, respectively.

The width h of the hole formed between the narrow parts X3 is 5% to 80% of the maximum width of the extension parts 42*c*1 and 42*c*2 of the transparent electrodes and 50% to 110% of the width of the second barrier rib 54*b*.

Therefore, according to the fourth embodiment, since the depressed parts 42*d*1 and 42*d*2 are formed in the first and second extension parts 42*c*1 and 42*c*2, a long gap is formed so that the efficiency of sustain discharge is improved. Also, since the width of the data electrode in the discharge space increases due to the plurality of narrow parts X3 and the hole between the narrow parts X3 in the wide part X1 of the data electrode, the distance between the effective side surfaces of the data electrode and the pair of sustain electrodes is reduced so that the efficiency of address discharge is improved.

The invention being thus described, it will be obvious that the same may be varied in many ways. Such variations are not to be regarded as a departure from the spirit and scope of the invention, and all such modifications as would be obvious to one skilled in the art are intended to be comprised within the scope of the following claims.

What is claimed is:

1. A plasma display apparatus, comprising:

three or more cells arranged on a rear surface substrate to be partitioned off by barrier ribs in a delta configuration;

data electrodes arranged under the cells and having wide parts corresponding to discharge spaces within the cells and narrow parts extending between the wide parts;

pairs of sustain electrodes arranged on a front surface substrate attached to the rear surface substrate to at least partially overlap the barrier ribs; and extension parts extended from respective sustain electrodes of at least one of the pairs of sustain electrodes into a corresponding one of the cells to face each other, each extension part having at least one recess that overlaps and extends substantially in a same direction as the data electrodes, wherein a distance between the recesses of the extension parts is greater than a distance between other areas of the extension parts in said one of the cells, wherein each extension part and the at least one recess of each extension part are aligned with a wide part of a corresponding one of the data electrodes, and wherein the wide part of said corresponding one of the data electrodes is aligned with a central area of the discharge space of said one of the cells.

2. The plasma display apparatus as claimed in claim 1, wherein the barrier ribs comprise: first barrier ribs that at least partially overlap the pairs of sustain electrodes; and second barrier ribs that at least partially overlap the data electrodes and the first barrier ribs.

3. The plasma display apparatus as claimed in claim 1, wherein the narrow parts at least partially overlap second barrier ribs that partition off the cells and that are non-discharge spaces.

4. The plasma display apparatus as claimed in claim 1, wherein the extension parts at least partially overlap a wide part of a data electrode that crosses said cell.

5. The plasma display apparatus as claimed in claim 1, wherein the recesses formed in the extension parts of said cell at least partially overlap the wide parts of a data electrode that crosses said cell.

6. The plasma display apparatus as claimed in claim 1, wherein the distance between the extension parts is approximately 60 to 180 μm.

7. The plasma display apparatus as claimed in claim 1, wherein extension parts in adjacent cells are separated from each other.

8. The plasma display apparatus as claimed in claim 1, wherein a width of the wide parts of the data electrodes is approximately 75% to 150% of a width of the extension parts.

9. The plasma display apparatus as claimed in claim 1, wherein a width of the narrow parts of the data electrodes is approximately 5% to 75% of a width of the extension parts.

10. The plasma display apparatus as claimed in claim 1, wherein each wide part of the data electrodes comprises a plurality of narrow parts and at least one hole formed between the narrow parts.

11. A plasma display apparatus, comprising:

three or more cells arranged on a rear surface substrate to be partitioned off by barrier ribs in a delta configuration;

data electrodes arranged under the cells;

pairs of sustain electrodes arranged on a front surface substrate attached to the rear surface substrate to at least partially overlap the barrier ribs; and extension parts extended from at least one of the pairs of sustain electrodes into a corresponding one of the cells to face each other, each extension part having at least one recess on a facing surface that overlaps and extends in substantially a same direction as the data electrodes, wherein a distance between the recesses of the extension parts is greater than a distance between other areas of the extension parts in said one of the cells, wherein each extension part and the at least one recess of each extension part are aligned with a corresponding one of the data electrodes, and wherein the corresponding one of the data electrodes is aligned with a central area of a discharge space of said one of the cells.

12. The plasma display apparatus as claimed in claim 11, wherein the barrier ribs comprise:

first barrier ribs that at least partially overlap the pairs of sustain electrodes; and second barrier ribs that at least partially overlap the data electrodes and the first barrier ribs.

13. The plasma display apparatus as claimed in claim 11, wherein the data electrodes at least partially overlap the extension parts and/or recesses in the cells.

14. The plasma display apparatus as claimed in claim 11, wherein the distance between the extension parts is approximately 60 to 180 μm in the cells.

15. A plasma display apparatus, comprising:

three or more cells arranged on a rear surface substrate to be partitioned off by barrier ribs in a delta configuration;

data electrodes arranged under the cells and having wide parts corresponding to discharge spaces within the cells and narrow parts extending between the wide parts;

pairs of sustain electrodes arranged on a front surface substrate attached to the rear surface substrate to at least partially overlap the barrier ribs;

extension parts extended from at least one of the pairs of sustain electrodes into a corresponding one of the cells to face each other; and first and second electrode segments connecting the extension parts of said one of the cells that face each other, the first and second electrode segments spaced from one another by a predetermined distance, wherein the barrier ribs of each cell are arranged in a pattern different from a rectangle, and wherein the pair of sustain electrodes of each cell at least partially overlap and follow at least a substantially same pattern as respective ones of the barrier ribs so as not to overlap any portion of a discharge space of each cell.

16. The plasma display apparatus as claimed in claim 15, wherein the barrier ribs comprise:

first barrier ribs that at least partially overlap the pairs of sustain electrodes; and second barrier ribs that at least partially overlap the data electrodes and the first barrier ribs.

17. The plasma display apparatus as claimed in claim 15, wherein the narrow parts at least partially overlap second barrier ribs that partition off the cells and that are non-discharge spaces.

18. The plasma display apparatus as claimed in claim 15, wherein the extension parts and/or recesses at least partially overlap the wide parts in the cells.

19. The plasma display panel as claimed in claim 1, wherein the pairs of sustain electrodes follow along the barrier ribs.

20. The plasma display panel as claimed in claim 11, wherein the pairs of sustain electrodes follow along the barrier ribs.

21. The plasma display panel as claimed in claim 15, wherein the pairs of sustain electrodes follow along the barrier ribs.

22. The plasma display apparatus as claimed in claim 15, wherein outer edges of the first and second electrode segments are separated by a distance greater than a width of the narrow parts of the data electrodes.

23. The plasma display apparatus as claimed in claim 22, wherein widths of each of the first and second electrode segments are 1% to 30% of a maximum width of corresponding ones of the extension parts.

24. The plasma display apparatus as claimed in claim 23, wherein the predetermined distance separating the first and second electrode segments is 5% to 80% of the maximum width of corresponding ones of the extension parts.

25. The plasma display apparatus as claimed in claim 15, wherein ends of the first and second electrode segments contact respective ones of the extension parts and are not connected to one another.

26. A plasma display apparatus, comprising:

three or more cells arranged on a rear surface substrate to be partitioned off by barrier ribs in a delta configuration;

data electrodes arranged under the cells and having wide parts corresponding to discharge spaces within the cells and narrow parts extending between the wide parts;

pairs of sustain electrodes arranged on a front surface substrate attached to the rear surface substrate to at least partially overlap the barrier ribs;

extension parts extended from at least one of the pairs of sustain electrodes into a corresponding one of the cells to face each other, wherein the barrier ribs of each cell are arranged in a pattern different from a rectangle, wherein the pair of sustain electrodes of each cell at least partially overlap and follow at least a substantially same pattern as respective ones of the barrier ribs so as not to overlap any portion of a discharge space of each cell, wherein each extension part has at least one recess aligned along an axis passing through a central portion of a discharge space of said one of the cells, and wherein a distance between the recesses of the extension parts is greater than a distance between other areas of the extension parts.

27. The plasma display apparatus as claimed in claim 26, wherein the recess in each extension part is substantially in a V-shape.

28. The plasma display apparatus as claimed in claim 26, wherein the recess in each extension part is substantially in a rectangular shape.

29. The plasma display apparatus as claimed in claim 26, wherein the recess in each extension part has four sides connected at angles other than right angles.

30. The plasma display apparatus as claimed in claim 26, wherein the recess in each extension part is substantially in a U-shape.

* * * * *